United States Patent [19]

Lin et al.

[11] Patent Number: 4,734,879

[45] Date of Patent: Mar. 29, 1988

[54] ANALOG COMPUTING METHOD OF SOLVING A SECOND ORDER DIFFERENTIAL EQUATION

[76] Inventors: Hung C. Lin, 8 Schindler Ct., Silver Spring, Md. 20903; Hwey C. Chien, Steward Towers, Rm. 1411, 200 Fort Meade Rd., Laurel, Md. 20707

[21] Appl. No.: 779,429

[22] Filed: Sep. 24, 1985

[51] Int. Cl.[4] ..... G06G 7/18

[52] U.S. Cl. ..... 364/810; 364/807

[58] Field of Search ..... 364/800–802, 364/807–808, 810, 600, 602, 605

[56] References Cited

U.S. PATENT DOCUMENTS

| | | | |
|---|---|---|---|
| 3,231,723 | 1/1966 | Gilliland et al. | 364/810 X |
| 3,546,443 | 12/1970 | Niblock | 364/810 X |
| 3,628,001 | 12/1971 | Niblock | 364/810 X |
| 3,652,843 | 3/1972 | Kurokawa et al. | 364/810 X |
| 3,996,456 | 12/1976 | Hoover | 364/807 X |
| 3,996,457 | 12/1976 | Gabriel | 364/810 X |
| 4,074,113 | 2/1978 | Gabriel | 364/810 X |
| 4,471,451 | 9/1984 | Schenck | 364/605 |

*Primary Examiner*—Gary V. Harkcom

[57] ABSTRACT

A method of measuring the depletion layer width and electric field of a semiconductor junction or barrier with a particular impurity distribution profile in the semiconductor. With analog computation technique, a time-varying signal is used to simulate the impurity profile. Automatic generation of the constants of integration for the solution of Poisson's differential equation is achieved by adjusting pulse repetition rate or by iterative bisection method.

13 Claims, 7 Drawing Figures

ANALOG COMPUTING METHOD OF SOLVING A SECOND ORDER DIFFERENTIAL EQUATION

BACKGROUND

In a semiconductor junction device or a field effect device, it is often required to know the electric field and the depletion width of the device. The maximum electric field determines the maximum voltage that can be applied to the device. The depletion width determines the junction capacitance. To obtain such information analytically, one must solve the Poisson's equation.

In modern semiconductor devices, the impurity concentration is generally not uniform. Impurities are usually introduced to the semiconductor either by ion implantation or thermal diffusion to tailor the device characteristics. These impurities give rise to a nonuniform profile. Such profiles may describe a Gaussian distribution, a complementary error function, or a combination thereof. The Poisson's equations of such complicated profile are generally not easily solved by analytical methods. If numerical methods are used, the double integration, together with boundary condition determination, may require a large amount of computation time. What is needed is an efficient method to determine the electric field and capacitance of a p-n junction with a uniform impurity concentration background.

SUMMARY OF THE INVENTION

An object of this invention is to devise a method to analyze the characteristics of a semiconductor p-n junction with nonuniform background impurity concentration efficiently.

Another object of this invention is to determine the electric field of a p-n junction.

Still another object of this invention is to determine the depletion layer width or junction capacitance of a p-n junction.

These objects are obtained with analog computation technique. A time-varying signal is used to simulate the impurity profile. A unique feature of this invention is the automatic generation of the constants of integration in the solution of the Poisson's differential equation. This is done by adjusting the pulse repetition rate or by using the bisection method iteratively.

DETAILED DESCRIPTION OF THE PREFERRED EMBODIMENT

When a reverse bias is applied across a semiconductor p-n junction, the potential distribution as a function of distance is governed by the Poisson's equation. Take the simple case of a static one-dimensional Poisson's equation $$(d^2V)/(dx^2) = -(q/\epsilon)N(x) \tag{1}$$

where V is the voltage, x is the distance, q is the electronic charge, $\epsilon$ is the dielectric constant, and N(x) is the background impurity concentration which may be a function of distance. To find out the potential distribution, one must solve this differential equation. After first integration, $$\frac{dV}{dx} = \frac{q}{\epsilon} \int_0^x N dx + C_1 \tag{2}$$

where $C_1$ is a constant of integration and can be determined by boundary conditions. At the edge of the depletion layer W, the electric field is equal to zero.

$$\left(\frac{dV}{dx}\right)_{x=w} = -\frac{q}{\epsilon} \int_0^W N dx + C_1 = 0 \tag{3}$$

The constant of integration $C_1$, is then $$C_1 = \frac{q}{\epsilon} \int_0^W N dx. \tag{4}$$

Next, integrate Eq. (2):

$$V = -\frac{q}{\epsilon} \int_0^W \int_0^x N dx + \frac{q}{\epsilon} \times \int_0^W N dx + C_2. \tag{5}$$

If the voltage at x=0 is taken as zero, $C_2=0$. Differential equation (5) can be solved with analog computation technique.

After the first integration of the second-order differential equation (1), one must put in the boundary conditions before the next integration. In other words, the value of the constant of integration $C_1$ in equation (3) must be known. However, at this point in computation, the edge of the depletion layer W is not yet known. Not knowing the value of W, one cannot proceed to integrate equation (5).

According to this invention, we propose two novel methods to solve this problem.

Figure 1:
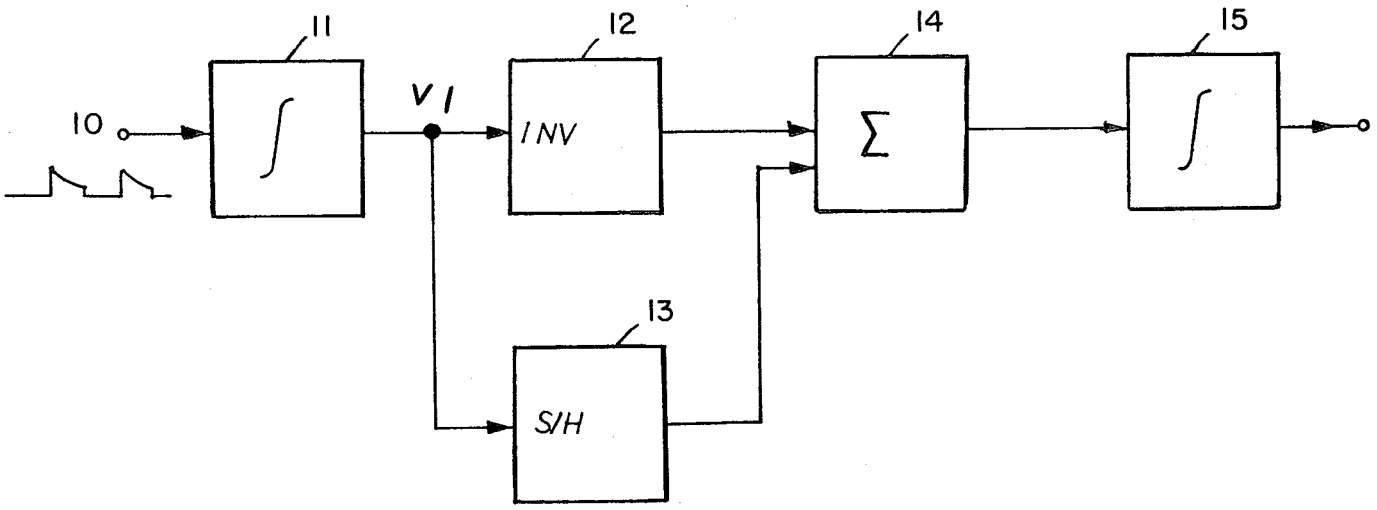
FIG. 1 is a schematic block diagram showing the basic functions of each component block for implementing this invention, featuring a sample-hold functional block.

In the first method, the time of integration is varied until the voltage as expressed in equation (5) is satisfied. The basic block diagram is shown in FIG. 1. In this diagram, there is an integrator 11, an inverter 12, a sample-hold voltage follower 13, a summing amplifier 14, and a second integrator 15. The input signal is a periodic wave 10. The waveshape corresponds the impurity profile N(x) with time t replacing the depth x. The waveform can be rectangular for a uniform background or can assume other shapes for nonuniform background. The period T of this wave is adjustable.

This wave is impressed at the input of the first integrator 11 which yields an output at $V_1$. If time t is used to simulate distance x, the output $V_1$ is equal to the integral in equation (3), $$-\frac{q}{\epsilon}\int_0^t Ndt.$$

At a time $t=t_2$, corresponding to the edge of depletion layer width where the electric field $dV/dt=0$, this boundary condition as given in equation (4) yields an integral $$C_1=\frac{q}{\epsilon}\int_0^{t_2} Ndt. \quad (6)$$

This quantity is a constant for subsequent integration and is held in a sample-hold circuit 13.

This constant $C_1$ is summed with the integral $$-(q/\epsilon)\int_0^t Ndt$$

in the summing amplifier 14 to give an output $$\dot{v}=-\frac{q}{\epsilon}\int_0^t Ndt+\frac{q}{\epsilon}\int_0^{t_2} Ndt.$$

This quantity is the electric field as a function of distance. The output of the summer 14 is integrated again in the integrator 15 to yield an output $$-\frac{q}{\epsilon}\int_0^{t_2}\int_0^t Ndt+\frac{qx}{\epsilon}\int_0^{t_2} Ndt. \quad (7)$$

By adjusting $t_2$, the period, this final integral can be varied until the amplitude is equal to the desired applied voltage $V_A$. Then, the time period $t_2$ is a measure of the depletion layer width W.

Figure 2:
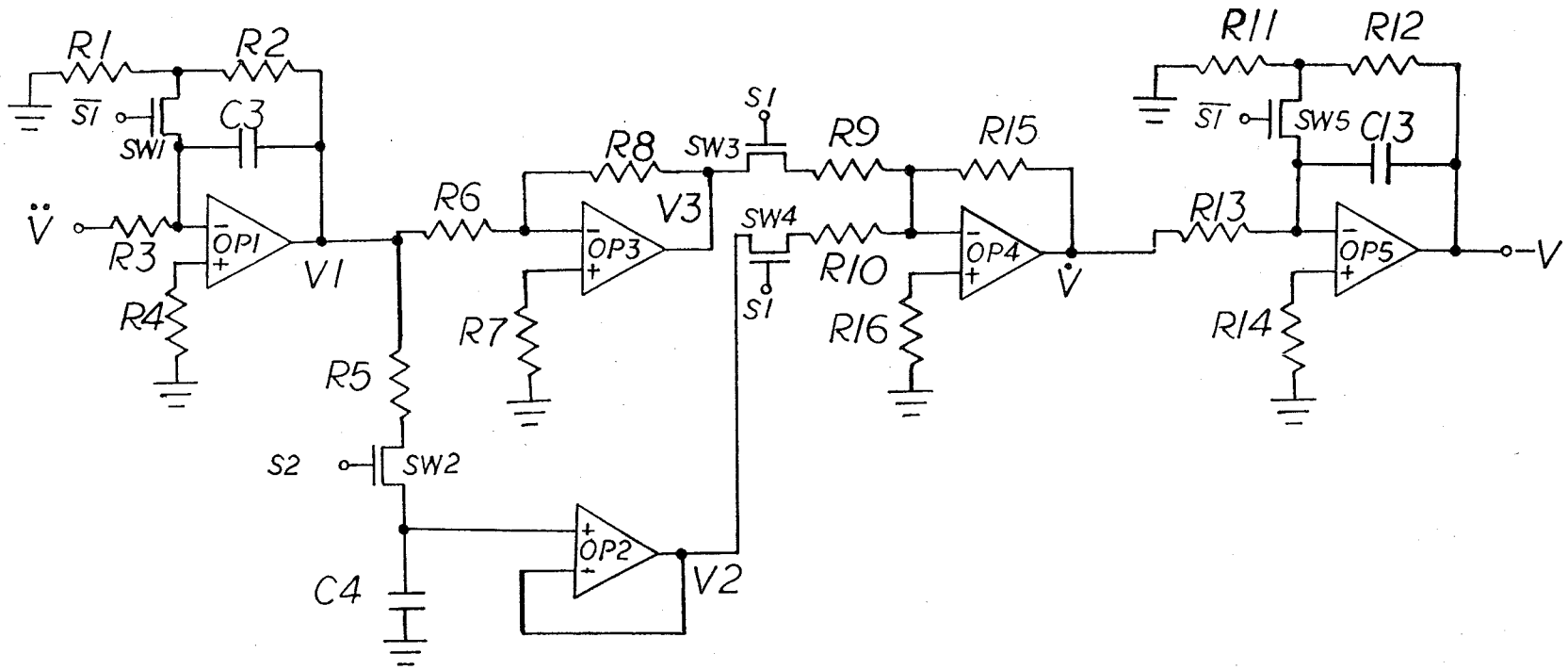
FIG. 2 is a schematic circuit diagram showing how the concept in FIG. 1 is constructed with electronic parts.

The actual implementation of the analog computation of the Poisson's equation is shown in FIG. 2. The integrator 11 consists of an operational amplifier Op1, an input resistor $R_1$, integrating capacitor $C_1$, a balancing resistor $R_4$, initial setting resistors $R_2$ and $R_3$, and an initial setting switch SW1.

The setting switch SW1 is controlled by a rectangular clock signal $\bar{S}1$. when $\bar{S}1$ is high, SW1 is closed. the initial output voltage $V_1$ is set at zero. When SW1 is subsequently opened, the output voltage begins to integrate. The output voltage is related to the RC time constant and time as follows:

$$V_1=-\frac{1}{RC}\int_0^t V_i dt \quad (8)$$

The clock pulse $S_1$ for controlling SW1 has four durations: $t_1$, the reset time, and $t_2$, the integration time. During $t_1$, $\dot{V}$ is reset to an initial voltage. During $t_2$, the input signal $\dot{V}_i$ is integrated. The time sequence is repeated during the next two durations $t_3$, the resetting time, and $t_4$, the integration time. Thus $t_1=t_3$, $t_2=t_4$.

A sample-hold circuit 13 consists of a sampling switch SW2, a holding capacitor $C_4$, and an operational amplifier Op2. The sampling switch is preferably another MOSFET. When SW2 is closed by applying a clock pulse at the gate, voltage $V_1$ is charging the sampling capacitor $C_4$ through a resistor $R_5$. $V_1$ is the voltage at the output of the first integrator. The clock pulse $S_2$ for controlling SW2 is half the pulse repetition rate of the clock pulse $S_1$ for controlling SW1. The clock $S_2$ is timed such that it opens SW2 at the end of integration time $t_2$ of $S_1$. The voltage $V_1(t=t_1)$ at time $t_1$ is then held by $C_4$ and is equal to $$\int_0^{t_2} Ndt.$$

The voltage is held during subsequent clock cycle of $S_1$ with resetting time $t_3$ and integration time $t_4$ because SW2 is open. This voltage is applied to the noninverting input of an operational amplifier Op2, serving as a voltage follower with output $V_2$.

The voltage at $V_1$ is also fed to an inverter consisting of input resistance $R_6$, $R_7$, and an operational amplifier OP3. Thus, the input voltage $V_1$ to the inverter is inverted at the output as $V_3$.

The outputs of the voltage follower Op2 and the output of the inverter Op3 are fed to a summing amplifier 14 through two pass transistors SW3 and SW4 serving as switches. These switches are also controlled by clock pulses $S_1$. The summing amplifier is an operational amplifier with two input resistors $R_9$ and $R_{10}$ and a feedback resistor $R_{15}$.

During $t_4$, when switches SW3 and SW4 are closed, $V_2$ and $V_3$ are summed and inverted, appearing as V at the output of Op4. This inverted sum is equal to $$-\frac{q}{\epsilon}\int_0^t Ndt+\frac{q}{\epsilon}\int_0^{t_2} Ndt.$$

This quantity is integrated with an integrator Op5 which is similar to the integrator Op1. The functions of resistors $R_{11}$, $R_{12}$, $R_{13}$, $R_{14}$ and $C_{13}$ are similar to that of $R_1$, $R_2$, $R_3$, $R_4$ and $C_3$ respectively.

$$V=-\frac{q}{\epsilon}\int^{t_2}\int_0^t Ndt+\frac{q}{\epsilon}\times\int_0^{t_2} Ndt.$$

The amplitude of $V_o$ can be adjusted by changing the period of the clock pulse. When V is adjusted to be equal to the applied voltage $V_A$, the time $t_2$ or $t_4$ corresponds to the depletion layer W.

Figure 3:
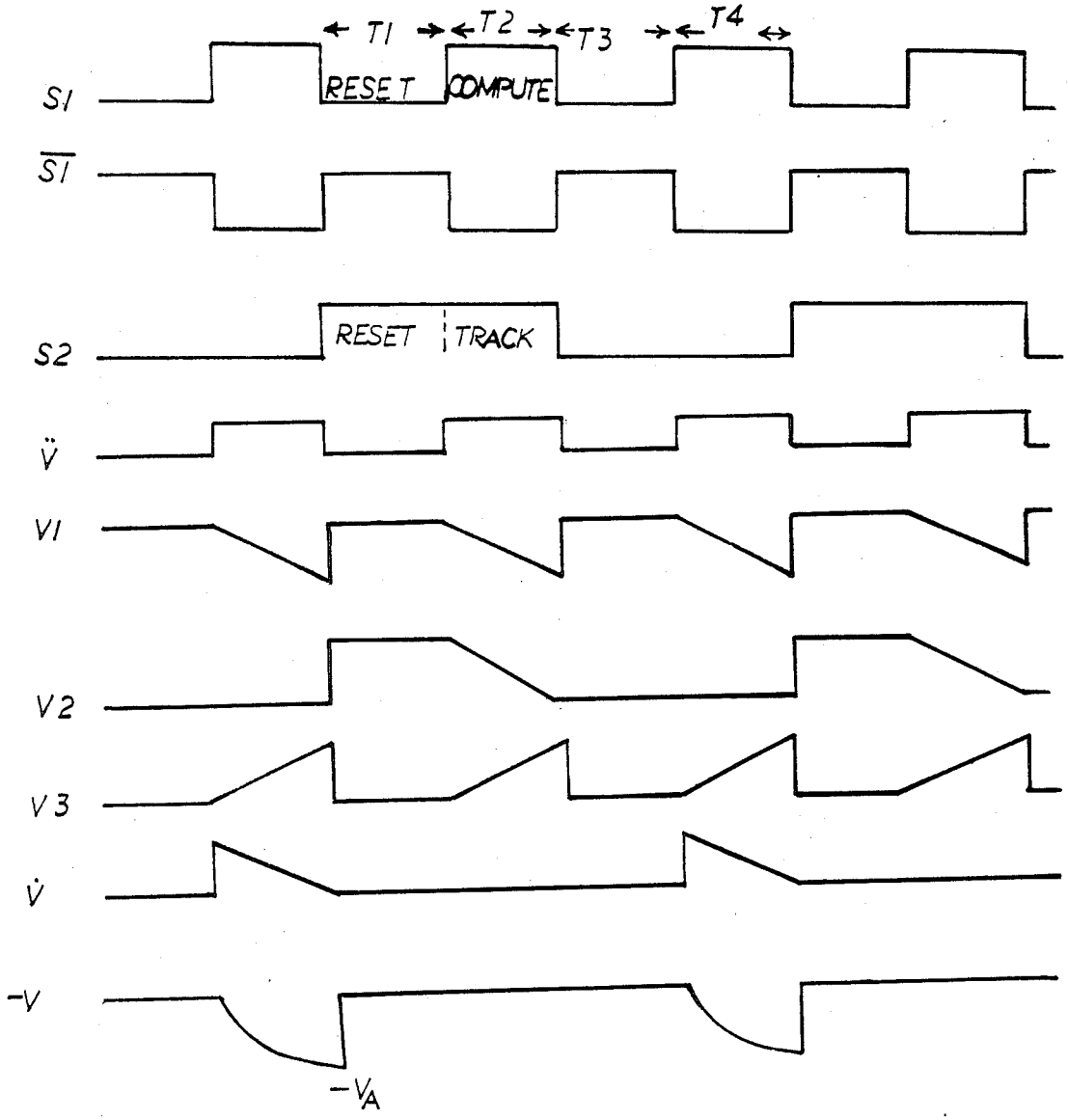
FIG. 3 is a timing diagram of the various voltages at different points of the circuit shown in FIG. 2.

FIG. 3 shows the waveforms at various points described in FIG. 2 for a uniform background. This condition is represented by a rectangular waveform $\ddot{V}$. When $\ddot{V}$ is first integrated, the output is reset to zero during resetting time $t_1$, $t_3$, and is a sawtooth during integration time $t_2$, $t_4$, as shown in $V_1$. At the end of integration period $t_4$, the sample-hold circuit holds $V_2$ constant during $t_3$ and $t_4$. During $t_4$, $V_2$ and $V_3$, which is the inverse of $V_1$, are summed and appear as V at the output of the summing amplifier as a declining sawtooth. When $\dot{V}$ is integrated again, an output voltage $-\dot{V}$ is obtained which has a square law relationship with time for uniform background. By adjusting the pulse repetition frequency, the amplitude of $|-V|$ can be varied to be equal to the applied voltage.

In FIG. 2, a one-sided step junction with uniform background impurity concentration is assumed. If the background concentration is not uniform, the input waveform should not be a flat-top rectangular wave. The waveform should vary with time corresponding to the impurity profile of the substrate. For instance, an exponential profile $N_s \exp(-x/x_p)$ (where $N_2$ is the surface concentration, x is distance and $x_p$ a characteristic length) should be represented as an exponentially decaying waveform. Such a waveform can be generated with waveform generation techniques well-known to the art.

Figure 4:
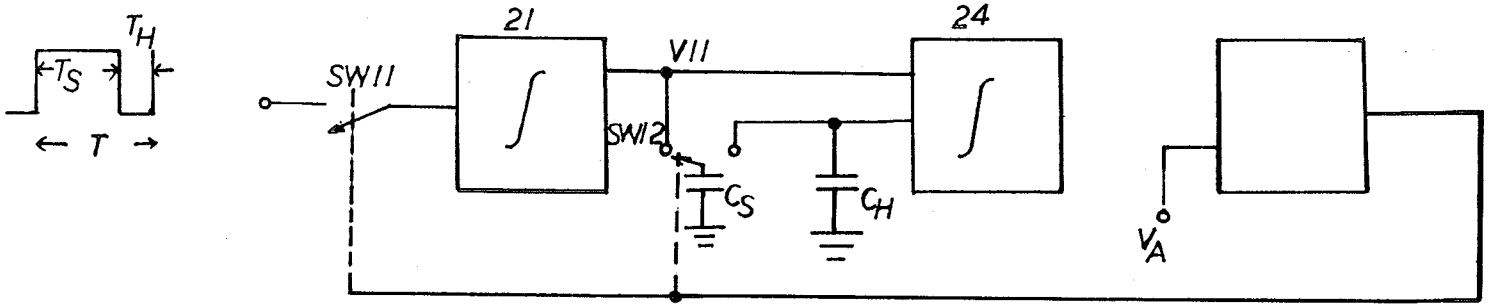
FIG. 4 shows a second embodiment of the present invention where the sample-hold circuit uses a fixed sampling frequency.

Another embodiment of the present invention is to use a fixed pulse repetition frequency and use a bisection method iteratively to obtain the constant of first integration. The method is shown in FIG. 4.

A pulse, whose amplitude is proportional to $-qN/\epsilon$, is periodically fed to the input of an integrator 21 through a switch SW1. Let us first consider the case where N(x) is uniform. Then, the input is represented as a square-wave. The pulse repetition time should be longer than any conceivable depletion layer width.

The output of the integration 21 is $\int_0 N dx$. To obtain the electric field described by equation (2), the constant of integration should be included. The value of $C_1$ and $$-\int_0^x N dx$$

are therefore added in the following adder, 23. At the beginning, the value of $C_1$ is not known. Sample-hold technique is used to determine the value of $C_1$. This is accomplished by using a holding capacitor $C_h$ at the input of the next integrator 24. Another sampling capacitor $C_s$ is switched to the output of the first integrator as long as N(x) is integrated. The initial value of $C_1$ can be any convenient value, say, $C_{1\ old}$. The output of the subtractor is fed to a second integrator 24. The output of this integrator is then the voltage as given by equation (5).

If this voltage equals the assigned value $V_A$, the input pulse is disconnected from the first integrator 21. At the same time, the sampling capacitor $$\frac{q}{\epsilon}\int_0^x N dx = V_{cs}.$$

After switching, the voltage $V_C$ across the parallel $C_s$ and $C_h$ is the average voltage between sampling voltage $V_S$ originally across $C_s$ and the holding voltage $V_h$ originally across $C_h$. If $C_s$ and $C_h$ are of equal value, $$V_C = \frac{V_s + V_h}{2} \tag{9}$$

When the next input pulse rises again, the sampling capacitor $C_s$ is switched back to the output of the first integrator. Because of holding action, the voltage across $C_h$ now assumes the new value given by equation (9). For every successive iteration, the sampling voltage and the holding voltage get closer. This method is equivalent to the bisection numerical method for digital computers. Finally, after several iterations, steady state will be reached when the sampling voltage and the holding voltage are the same.

Figure 5:
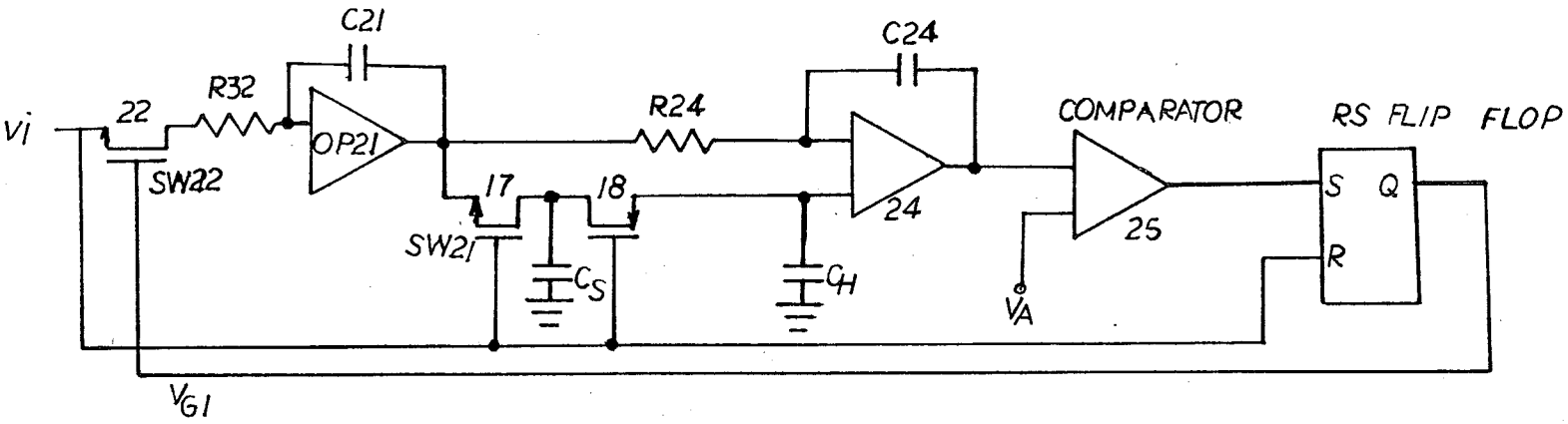
FIG. 5 shows how the concept of FIG. 4 can be implemented with electronic components.

This basic scheme shown in FIG. 4 can be implemented with conventional integrated circuits and MOSFET transmission gates. A possible circuit schematic diagram is shown in FIG. 5. In this figure, the input switch SW11 in FIG. 4 is a MOSFET transmission gate 22. The integrator 21 is an operatinal amplifier with integrating capacitor $C_{21}$ and resistor $R_{32}$. The single pole double throw switch SW12 in FIG. 5 is the complementary MOSFET transmission gates 17 and 18. Transmission gates 22 and 18 are closed when the gate input voltage $V_{G1}$ is high. The second integrator 24 in FIG. 4 is implemented with another operational amplifier 24 and integrating capacitor $C_{24}$ and resistor $R_{24}$. The comparator 25 gives a high output voltage $V_{G1}$ when its inverting input reaches a given voltage $V_a$. This output voltage and the input voltage $V_n$ are fed to a SET-RESET flip-flop or a latch. The output of the latch in turn controls the transmission gates. The complement of the input pulse is also connected to the RESET input of the latch. During the RESET of the input pulse, the latch is reset to a high output, thereby closing the input switch and connecting the sampling capacitor back to the output of the first integrator.

Figure 6:
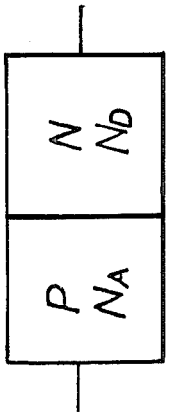
FIG. 6 shows the cross-section of a basic semiconductor p-n junction. The junction may not be abrupt and impurity distribution on the two sides of junction may not be uniform.

This invention can also be applicable to a two-sided junction as shown in FIG. 6. Take the simple case of a step p-n junction with p-type impurity concentration equal to $N_a$ and n-type impurity concentration equal to $N_d$. Let the distance in p-type be $x_a$ and n-type be $x_d$. When a voltage is applied across the junction, the negative space charge region on the p-type region must be equal and opposite to the positive space charge region in the n-type region.

$$q\int_0^{W_a} N_a dx_a = q\int_0^{W_d} N_d dx_d \tag{10}$$

where $W_a$ and $W_d$ are edges of the depletion region. This integral of impurity concentration is equal to the electric field. If $x_A$ represents the time, the relationship between $x_a$ and $x_d$ can be obtained by differentiating both sides of this equation, i.e., $$N_a = N_d(dx_d/dx_a). \tag{11}$$

When $$\int_0^{W_d} \dot{V}_d dx_d$$

is further integrated to obtain $V_d$, one must modify the variable which represents $x_1$. One can change the variable as follows:

$$\int_0^{W_d} \dot{V}_d dx_d = \int_0^{W_a} \dot{V}_d \cdot \frac{dx_d}{dx_a} \cdot dx_d \tag{12}$$

From equation (11), $$dx_d/dx_a = N_a/N_d. \tag{13}$$

Figure 7:
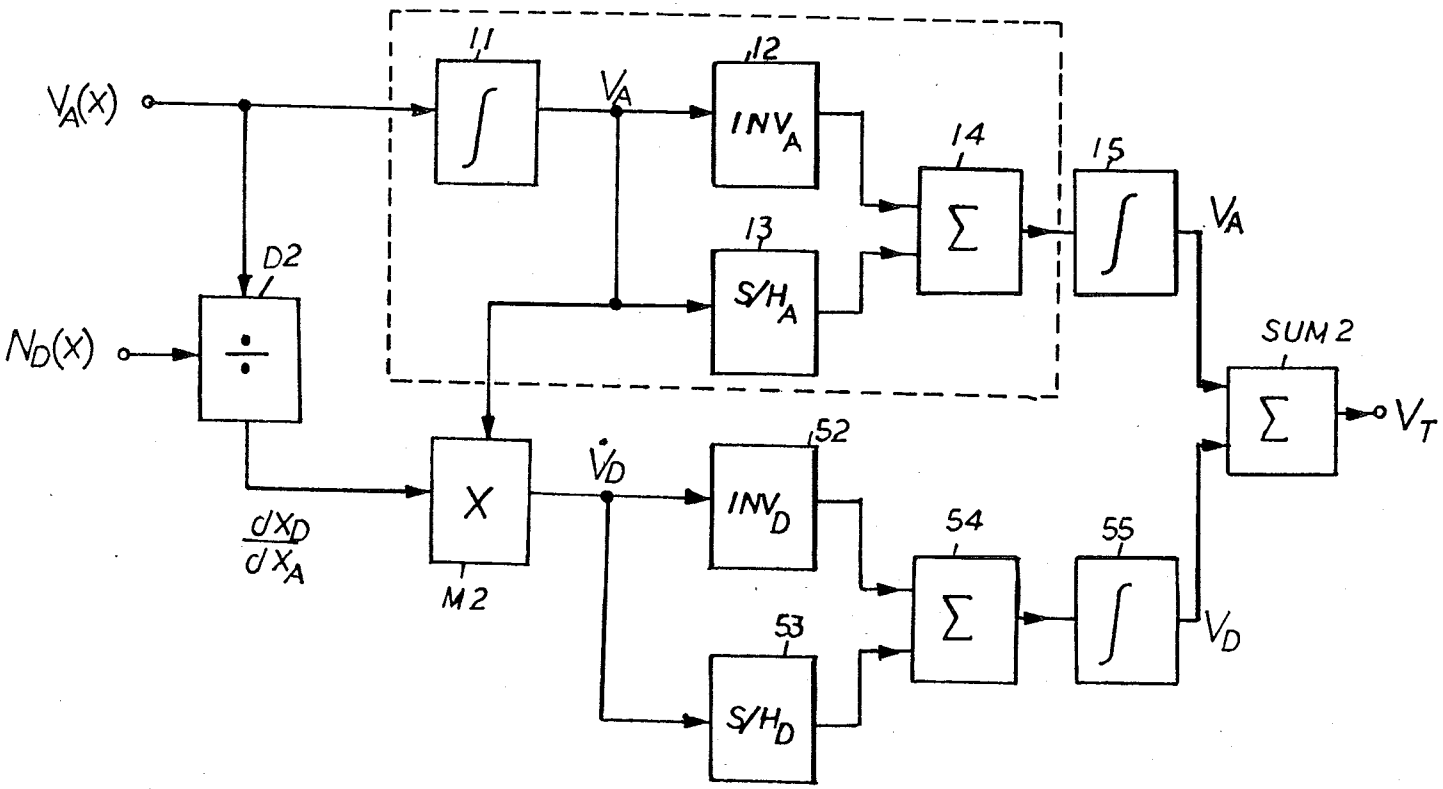
FIG. 7 is a schematic block diagram showing how the present invention can be used to solve the Poisson's equation for a two-sided junction with non-uniform impurity distribution.

This quantity can be obtained with a divider. An overall scheme is shown in FIG. 7. The top half of the diagram within the dotted block $B_1$ is the same as the block diagram shown in FIG. 1. The output voltage $V_{01}$ represents the voltage drop across the depletion layer in one side of the junction, say, the n-region. The lower dotted block is the solution of the Poisson equation for the other side of the junction n-region. This block includes a divider $D_2$ and a multiplier $M_2$. As explained previously, the divider divides $N_a$ by $N_d$ to obtain the value $dx_d/dx_a$. The derivative is then multiplied by $V_a$ to obtain $V_d$. This signal is then in the same manner as $V_a$ in the upper block through a sample-hold circuit $S/H_2$, an integrator Int 3, and a summing amplifier SUM2. $V_a$ and $V_a$ represent the voltage drops across each side of the junction. The sum is the total voltage $V_t$ across the junction. When the total voltage is adjusted to be equal to the applied voltage, the solution is found.

What is claimed is:

1. A method of solving a second order differential equation using an analog computation circuit technique, said differential equation having a derivative of an unknown quantity V with respect to a variable X, comprising the steps of first integrating said second derivative of the differential equation to obtain a first integral with an electronic integrator, deriving a constant of integration based on first boundary conditions of said unknown quantity at a certain value of said variable using sample-hold circuit technique with a switched capacitor, summing said first integral with said constant of integration to obtain a sum with a summing amplifier, integrating said sum to obtain a second integral using a second electronic integrator, setting said second integral to a second boundary condition of said unknown quantity and another value of said variable by means of electronic adjustment.

2. A method of solving a second order differential equation as described in claim 1 wherein said equation is Poisson's equation relating potential distribution across a semiconductor p-n junction as a function of distance, which is represented by time.

3. A method of solving a second order differential equation as described in claim 1 wherein said unknown quantity for said integrating step is a time varying signal and said variable is time including a resetting time and an integration time, said sample-hold circuit technique including holding the value of said first integral at the end of said integration time.

4. A method of solving a second order differential equation as described in claim 3 wherein said resetting time and said integration time are adjusted to satisfy said second boundary condition.

5. A method of solving a second order differential equation as described in claim 3 wherein said sample-hold circuit technique includes varying said constant of integration iteratively until said second boundary condition is satisfied.

6. A method of solving a second order differential equation as described in claim 5 wherein said constant of integration is varied interactively by charging a capacitor used in said sample-hold circuit technique with values of said first integral repeatedly.

7. A method of solving a second order differential equation as described in claim 3 wherein said sample-hold circuit includes a sampling switch, a holding capacitor, and an operational amplifier.

8. A method of solving a second-order differential equation as described in claim 1 wherein said equation has two dimensions, each dimension having respective own said first boundary conditions and an interrelated common said second boundary condition.

9. A method of solving a second order differential equation as described in claim 8 wherein said first integral for one dimension is multiplied by a derivative to obtain a second integral for a second dimension, said derivative relating to said first boundary conditions of said both dimensions.

10. A method of solving a second order differential equation as described in claim 9 wherein said equation is a Poisson's equation for solving the potential distribution and depletion layer of a two-sided semiconductor p-n junction, with distance represented by time, when a voltage is applied across said junction.

11. A method of solving a second order differential equation as described in claim 10 wherein said second boundary condition equate the sum of said second integrals of both dimensions to said applied voltage.

12. A method of solving a second-order differential equation as described in claim 10 wherein said derivative is equal to the ratio of two impurity concentrations as a function of distance away on opposite sides from said junction.

13. A method of solving a second-order differential equation as described in claim 9 wherein said derivative is obtained by taking the ratio of said second derivative for both said dimensions.

* * * * *